United States Patent [19]

Saucier

[11] Patent Number: 4,511,255

[45] Date of Patent: Apr. 16, 1985

[54] CLEAN-IN-PLACE AGITATOR ASSEMBLY

[75] Inventor: David O. Saucier, St. Cloud, Minn.

[73] Assignee: DCI, Inc., St. Cloud, Minn.

[21] Appl. No.: 605,216

[22] Filed: Apr. 30, 1984

[51] Int. Cl.[3] ..... B01F 7/02

[52] U.S. Cl. ..... 366/138; 366/285; 366/286

[58] Field of Search ..... 134/169 R, 186, 187, 134/191; 366/138, 167, 168, 169, 176, 241, 279, 280, 285, 286, 289, 331, 349, 254

[56] References Cited

U.S. PATENT DOCUMENTS

| | | | |
|---|---|---|---|
| 1,635,936 | 7/1927 | Gotten | 366/169 |
| 1,808,353 | 6/1931 | Jackson | 384/151 |
| 2,347,195 | 4/1944 | Huff | 366/169 |
| 2,655,870 | 10/1953 | Yohpe | 366/176 |
| 2,826,401 | 3/1958 | Peters | 366/169 |
| 3,226,205 | 12/1965 | Rohlfing | 366/138 |
| 3,887,169 | 6/1975 | Maynard | 366/307 |
| 3,899,159 | 8/1975 | Nauta | 366/169 |
| 4,130,287 | 12/1978 | Ritzie | 277/12 |
| 4,168,918 | 9/1979 | de Jonge | 366/169 |
| 4,249,828 | 2/1981 | Condolios | 366/169 |
| 4,439,043 | 3/1984 | Daloz | 366/168 |

FOREIGN PATENT DOCUMENTS

| | | | |
|---|---|---|---|
| 763913 | 9/1971 | Belgium | 366/167 |

*Primary Examiner*—Robert W. Jenkins
*Assistant Examiner*—Arthur D. Dahlberg
*Attorney, Agent, or Firm*—Merchant, Gould, Smith, Edell, Welter & Schmidt

[57] ABSTRACT

An improved agitator assembly (10) for sanitary tanks includes a drive shaft (14) extending through a tubular housing (58, 84). A slide coupling (16) is connected between the outer end of the drive shaft (14) and a drive motor. An impeller (90) is secured to the other end of the drive shaft (14) which is supported on a bearing/seal member (86) in the inner end of the shaft housing (58, 84). The adjoining surfaces of the bearing/seal member (86) and impeller base (89) are normally engaged in rotary sealing relationship by springs (44, 78) but shift apart responsive to introduction of cleaning solution into the housing (58, 84) so that the cleaning solution is discharged into the tank at the base of the impeller (90) after washing the seals (74, 86) to facilitate cleaning without manual disassembly or scrubbing.

7 Claims, 3 Drawing Figures

CLEAN-IN-PLACE AGITATOR ASSEMBLY

TECHNICAL FIELD

The present invention relates generally to an agitator assembly for use with sanitary tanks. More particularly, this invention concerns a clean-in-place agitator assembly with an impeller and drive shaft that shift responsive to injection of cleaning solution under pressure into the drive shaft housing to facilitate cleaning of itself and the base of the impeller without manual intervention.

BACKGROUND ART

Liquids such as milk that must be periodically agitated are typically stored in tanks which include agitators or stirrer assemblies. Such tanks are also sometimes referred to as stirrer tanks. In addition to including agitator assemblies, such tanks usually must also be designed to facilitate internal cleaning for sanitary purposes. In the case of liquid food products, such as milk for example, both the interior of the tank and the agitator assembly must be cleaned periodically. Good sanitary tank design requires the product agitators to be as cleanable as the internal tank surface.

Devices have been available heretofore for cleaning such tanks. For example, U.S. Pat. No. 4,168,918 to DeJonge shows such a device wherein cleaning fluid is introduced through a hollow drive shaft with spray nozzles thereon which direct the fluid against opposite sides of the impeller and the inside of the seal in the tank wall surrounding the shaft. Two hollow coaxial shafts are utilized; one of which is outside the tank and coupled to the drive motor, and the other of which extends into the tank and connects the drive shaft to the impeller. The inside shaft is mounted so as to be easily removable from the drive shaft in order to clean the nozzles therein. At least some manual intervention in the form of disassembly, scrubbing or brushing, and reassembling part of the agitator, is necessary to effect thorough cleaning of the tank and the agitator assembly before reuse. This is time consuming and thus expensive.

Another approach has been to inject cleaning solution into the tank past a seal surrounding the tool shaft. For example, in the TEBEL OST-III, the tool shaft extends completely across the tank and is supported at one by the drive shaft and at the opposite end by a sliding bearing. The tool and drive shafts are keyed together for rotation in unison. The sanitary seal assembly consists of a pair of circumferential lip seals with a drained space or chamber between the seals. During cleaning, the seal assembly is flushed from the inside by forcing cleaning solution into the chamber and past the inner seal into the tank. Thus, whereas in the system shown in the DeJonge patent cleaning solution is sprayed onto the inside of the inner seal, in the TEBEL system cleaning solution is forced past the inner seal from the outside to the inside of the tank. There is no provision, however, in the TEBEL system for directing cleaning solution onto or past the bearing at the opposite end of the shaft, which must be brushed or scrubbed by hand to effect thorough cleaning.

The prior art has thus been characterized by partial disassembly of the agitator assembly and/or manual scrubbing to effect thorough cleaning of the interior of a tank. A need has thus developed for an improved agitator assembly which is constructed so as to facilitate cleaning of the portion of the housing surrounding the tool shaft internal to the tank, the base of the impeller or agitator mounted on the end of the tool shaft, and the seal between the shaft and the internal housing, without manual intervention.

SUMMARY OF THE INVENTION

The present invention relates to an improved agitator assembly for sanitary tanks which overcomes the foregoing and other difficulties associated with the prior art. In accordance with the invention, there is provided a clean-in-place agitator assembly including a drive shaft extending through the wall of a tank. The outer end of the drive shaft is connected by a slide coupling to a drive motor for limited axial movement. An impeller or other agitating device is secured to the inner end of the shaft. A hollow shaft housing surrounds the shaft, and a bearing/seal plug in the inner end of the housing serves to provide rotatable and slidable support for the shaft as well as a beveled seat for rotary sealing engagement with the complementary base of the impeller. The shaft and impeller are thus movable within the housing between seated and unseated positions on the bearing/seal plug, but are normally biased toward the seated position by a spring arrangement. Seals are provided between the drive shaft and the inner end of the housing. A passage is provided through the bearing/seal plug so that fluid from the annulus defined between the housing and the shaft can flow to the beveled seal surface at the end of the plug. The shaft and impeller shift away from the plug responsive to introduction into the housing of cleaning solution under pressure in order to clean the seals inside the housing as well as the base of the impeller without manual intervention.

BRIEF DESCRIPTION OF THE DRAWINGS

A better understanding of the invention can be had by reference to the following Detailed Description in conjunction with the accompanying Drawings, wherein.

DETAILED DESCRIPTION

Figure 1:
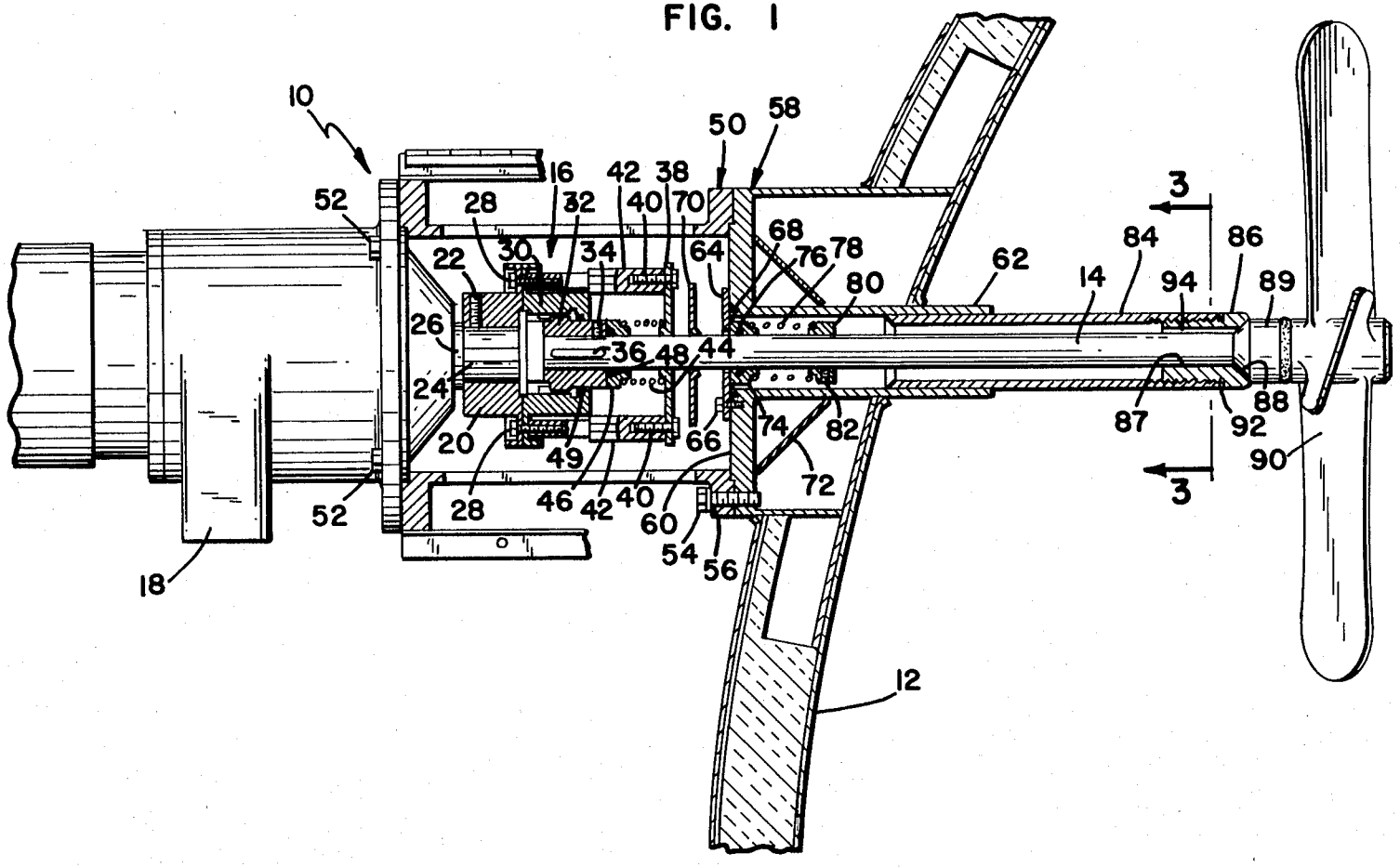
FIG. 1 is a sectional view of a portion of a tank incorporating the improved agitator assembly of the invention.
Figure 3:
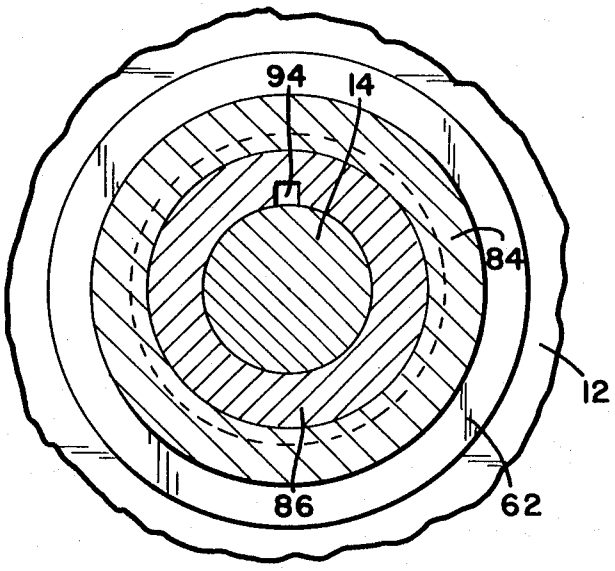
FIG. 3 is an enlarged sectional view taken along lines 3—3 of FIG. 1 in the direction of the arrows.
Figure 2:
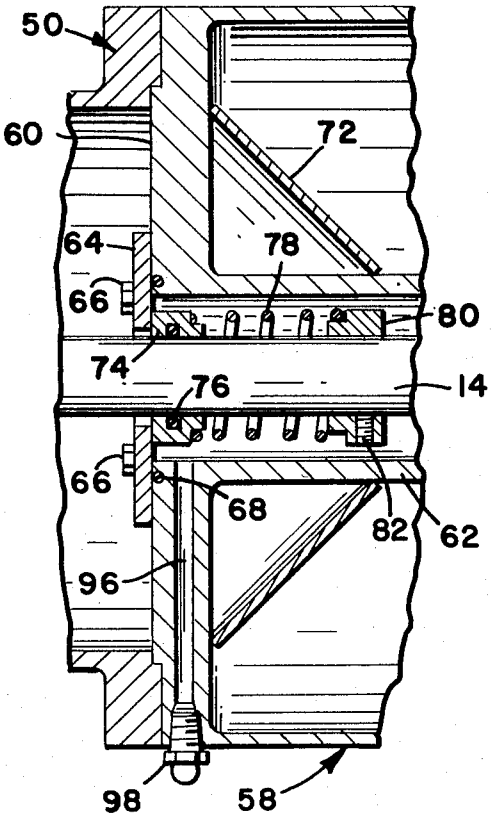
FIG. 2 is an enlarged partial sectional view taken along lines 2—2 of FIG. 1 in the direction of the arrows.

Referring now to the Drawings, wherein like reference numerals designate like or corresponding elements throughout the views, there is shown the improved agitator assembly 10 of the invention. The agitator assembly 10 is shown mounted in a generally horizontal position in the wall of a tank 12 of conventional insulated or uninsulated construction. For purposes of illustration, the tank 12 is shown as being of the insulated variety which is typically used for holding milk or other liquid requiring refrigeration as well as stirring or agitation with the agitator assembly 10. As will be explained more fully hereinafter, the agitator assembly 10 is constructed so as to facilitate cleaning thereof without partial disassembly or manual intervention in order to achieve more thorough cleaning of the interior of tank 12.

The agitator assembly 10 includes an elongate drive shaft 14 extending through the wall of the tank 12 such that the outer end of shaft is external to the tank and the inner end thereof is internal to the tank. The outer end of shaft 14 is connected via a slide coupling 16 to a gear motor 18. The slide coupling 16 can be of any suitable construction. For example, a slide coupling suitable for use in the improved agitator assembly 10 can be obtained from Sier-Bath Corporation of North Bergen, N.J.

As illustrated, the slide coupling 16 includes a first collar 20 which is secured by a set screw 22 and key 24 to the output shaft 26 of the gear motor 18. The first collar 20 is rigidly secured by bolts 28 to a second collar 30 for rotation therewith. Located within the second collar 30 is a sleeve 32 which is secured by a set screw 34 and key 36 to the outer end of the drive shaft 14. The respective inner and outer surfaces of the collar 30 and sleeve 32 include toroidal teeth in meshed engagement so that the motor output shaft 26 and the drive shaft 14 are coupled together for driving rotation in a manner which permits limited relative coaxial translation. An end plate 38 is mounted in spaced relationship with the second collar 30 by means of bolts 40 and tie rods 42. A compression spring 44 is located between the end plate 38 and a ring member or collar 46 including an O-ring seal 48 surrounding the shaft 14 and adjoining the end of the sleeve 32 in order to prevent leakage of lubricant from inside the coupling 16. The spring 44 serves to urge the tool shaft 14 and the sleeve 32 outwardly from the tank to the position shown. Another O-ring seal 49 is located between the sleeve 32 and collar 30.

The slide coupling 16 is located within an adapter 50. The gear motor 18 is secured by screws 52 to the outer end of the adapter 50. The inner end of the adapter 50 is secured by screws 54 and lock washers 56, only one pair of which is shown, to a shaft housing 58 mounted in the wall of the tank 12. The drive shaft 14 extends through the shaft housing 58 which is sealed at both ends to define an annulus into which cleaning solution is directed.

The shaft housing 58 includes an end plate or shoulder 60 located outside the tank 12, and a neck 62 which can be integral or separate as shown, extending through the wall of the tank. A seal plate 64 is secured to the outside of the shoulder 60 by bolts 66, only one of which is shown. A circular O-ring seal 68 is provided between the seal plate 64 and shoulder 60. If desired, a resilient umbrella shield 70 can be provided on the shaft 14 between seal plate 64 and the slide coupling 16 for purposes of protecting the coupling against any liquid running down the shaft, and a reinforcing cone 72 can be provided between the shoulder and the neck 62 for structural reinforcement.

A rotary seal 74 engaging the inside of the seal plate 64, including an O-ring seal 76 surrounding the drive shaft 14, are provided within the neck 62 of housing 58. A compression spring 78 is located between the rotary seal 74 and a collar 80 which is secured to the tool shaft 14 by a set screw 82. The spring 78 thus functions to urge the rotary seal 74 against the seal plate 64 to as to seal the outside end of the neck 62. Since the springs 78 and 44 urge the shaft 14 in opposite directions, the spring 78 must be of lesser compression than the spring 44 so that the net force of the two springs normally urges the shaft outward away from the tank 12.

The neck 62 of shaft housing 58 and a tubular sleeve 84, which is secured to the end of the neck portion of the housing, define an annular chamber surrounding the shaft 14. The sleeve 84 can be a separate member as illustrated, or an integral extension of the housing neck 62. A plug 86 is threaded or otherwise secured to the outer end of the sleeve 84. The plug 86, which preferably formed of plastic, includes an inside generally cylindrical passage 87 which functions as a journal bearing for the shaft 14, and a divergent opening 88 adjoining the central passage at the outer end of the plug which functions as a seat for sealing engagement with the convergent end of an adjoining base 89 secured to the agitator or impeller 90. A nylon gasket 92 is preferably provided between the plug 86 and sleeve 84. In addition, at least one longitudinal groove 94 is provided in the central passage 87 of the plug 86 for fluid communication from the annulus surrounding the drive shaft 14 and seat between the impeller base 89 and the plug. A radial passage 96 is provided in the end plate 60 at the opposite end of the annulus for fluid communication therewith when plug 98 is removed.

The improved agitator assembly 10 operates as follows. The motor 18 drives the impeller 90 through the slide coupling 16 and shaft 14. When it is desired to clean the interior of the shaft housing 58, plug 98 is removed and cleaning solution is introduced under pressure through the passage 96 and into the annulus surrounding the shaft 14 within the housing. The outer end of the annulus within the shaft housing 58 is closed off by the rotary seal 74 and the O-ring seal 76. Except for passage 94, the inner end of the annulus within the shaft housing 58 is substantially closed off by plug 86, the impeller base 89, and the gasket 92. The flow channel open to the interior of tank 12 comprises the passage 94 between bearing/seal plug 86 and shaft 14, and the conical seat 88. Pressure increases within the shaft housing 58 until it overcomes the net preloading of springs 44 and 78 and moves the impeller base 89 away from the plug 86 allowing the cleaning solution to flow by as spring 44 is compressed. The slide coupling 16 allows shaft 14 and impeller 90 to shift away from the bearing/seal plug 86. The spring 78, together with the pressure within the shaft housing 58, maintains sealing engagement between plate 64 and the rotary seal 74. When the pressure within the shaft housing 58 is relieved, the drive shaft 14 shifts back to its normal position with the impeller base 89 seated on the end of the bearing/seal plug 86. The remaining cleaning solution within the shaft housing 58 drains out by gravity via passage 96, after which plug 98 is replaced.

From the foregoing, it will thus be apparent that the present invention comprises an improved agitator assembly having several advantages over the prior art. One significant advantage is that the impeller and drive shaft can automatically shift away from a set, without any disassembly or stoppage of the agitator, so that after the seals surrounding the drive shaft has been washed, the cleaning solution is discharged at the base of the impeller to facilitate its cleaning as well without undue manual intervention. After the interior of the shaft housing, seals and impeller base have been cleaned, the shaft automatically shifts back to a closed position responsive to relief of pressure within the shaft housing for agitation of the tank contents. The bearing/seal member and impellor base are adapted for good wearability and service life. Other advantages will be evident to those skilled in the art.

Although particular embodiments of the invention have been illustrated in the accompanying Drawings and described in the foregoing Detailed Description, it will be understood that the invention is not limited only to the embodiments disclosed, but it intended to embrace any equivalents, modifications, substitutions, and- /or rearrangements of elements falling within the scope of the invention as defined by the following claims.

What is claimed is:

1. In an agitator assembly of the type including a motor connected to the outer end of a drive shaft extending through a tubular housing with an impeller secured to the inner end of the shaft, the improvement which comprises:

means defining a slide coupling interconnecting said motor and shaft for driving rotation and for limited axial movement of said shaft between inner and outer positions;

means for normally biasing said drive shaft toward the outer position;

seal means disposed between said drive shaft and the outer end of said shaft housing;

a bearing/seal member disposed between said shaft and the inner end of said shaft housing;

said impeller including a base portion adapted for rotary sealing engagement with a seat formed in an adjoining end of said bearing/seal member when said shaft is in the outer position;

said bearing/seal member including at least one longitudinal passage extending between the ends thereof; and means for introducing cleaning solution under pressure into said shaft housing and through the passage in said bearing/seal member to urge the base portion of said impeller away from said bearing-/seal member so that cleaning solution is discharged into the tank.

2. The agitator assembly of claim 1, wherein said slide coupling comprises:

said motor including an output shaft;

a first collar secured to the output shaft of said drive motor;

a second collar secured to said first collar and surrounding the outer end of said drive shaft;

a sleeve secured to the outer end of said drive shaft and extending into said second collar, said sleeve and said second collar being interconnected for rotary and axial sliding movement;

a first seal disposed between said sleeve and said second collar; and a second seal disposed between said drive shaft and said sleeve.

3. The agitator assembly of claim 1, wherein said seal means comprises:

a seal plate secured to the outer end of said housing and surrounding said drive shaft;

a rotary seal disposed inside said housing and surrounding said shaft;

a collar located in spaced relationship with said rotary seal and secured to said shaft;

a compression spring disposed between said collar and said rotary seal for urging said rotary seal into sealing engagement with said seal plate; and an O-ring seal disposed between said rotary seal and said shaft.

4. The agitator assembly of claim 1, wherein said means for introducing cleaning solution into said housing includes a passage in said housing opening into the interior thereof, and a removable plug closing the passage.

5. The agitator assembly of claim 1, further including an umbrella seal surrounding said shaft and disposed between said slide coupling means and said housing.

6. An agitator assembly for a tank, comprising:

an elongate hollow housing having an inner end located inside the tank and an outer end located outside the tank;

an elongate drive shaft extending through said shaft housing, said drive shaft having inner end extending beyond the inner end of said housing and an outer end extending beyond the outer end of said housing;

said housing surrounding said drive shaft in spaced apart relationship to define an annulus;

drive means;

a slide coupling rotatably connecting said drive means and the outer end of said shaft while permitting limited axial movement of said shaft relative to said shaft housing;

seal means disposed between said shaft and the outer end of said shaft housing;

a bearing/seal member disposed between the inner end of said shaft housing and said shaft;

an impeller secured to the inner end of said drive shaft, said impeller including a base portion adapted for rotary sealing engagement with a beveled seat formed in said bearing/seal member;

means for normally biasing said drive shaft such that the base portion of said impeller is urged into sealing engagement with said bearing/seal member;

said bearing/seal member including at least one longitudinal passage therein interconnecting the annulus within said housing with the seat formed thereon such that said impeller is responsive to pressure within the annulus to shift away from said bearing-/seal member allowing cleaning solution introduced innto said housing to discharge on the base portion of said impeller.

7. An agitator assembly for a tank, comprising:

an elongate hollow housing having an inner end and an outer end;

an elongate drive shaft extending through said shaft housing, said drive shaft having inner and outer ends;

drive means located outside the tank;

a slide coupling rotatably connecting said drive means and said shaft while permitting limited axial movement of said shaft relative to said shaft housing;

seal means disposed between said shaft and the outer end of said shaft housing;

a bearing/seal member disposed between the inner end of said shaft housing and said shaft;

an impeller secured to the inner end of said shaft, said impeller including a base portion adapted for rotary sealing engagement with a beveled seat formed in said bearing/seal member;

means for normally biasing the base portion of said impeller into sealing engagement with said bearing-/seal member;

said bearing/seal member including at least one longitudinal passage therein interconnecting the annulus within said housing with the seat formed thereon; and means for selectively introducing cleaning solution under pressure into the annulus within said housing to effect cleaning, said impeller being responsive to pressure within the annulus to shift away from said bearing/seal member allowing cleaning solution to discharge on the base portion of said impeller.

* * * * *